United States Patent [19]

Cooke

[11] 3,996,622

[45] Dec. 14, 1976

[54] FORM-FITTING TROUSERS

[76] Inventor: Ann V. Cooke, 45 Millbrook Lane, St. Louis, Mo. 63122

[22] Filed: Apr. 21, 1975

[21] Appl. No.: 569,840

Related U.S. Application Data

[63] Continuation-in-part of Ser. No. 350,724, April 13, 1973, abandoned.

[52] U.S. Cl. ..... 2/227

[51] Int. Cl.[2] ..... A41D 1/06

[58] Field of Search ..... 2/227, 228, 235, 238, 2/79, 80, 403

[56] References Cited

UNITED STATES PATENTS

| | | | |
|---|---|---|---|
| 237,004 | 1/1881 | Ferris | 2/227 |
| 693,276 | 2/1902 | Klavinsky | 2/227 |
| 3,323,140 | 6/1967 | Morris | 2/227 |
| 3,435,462 | 4/1969 | Bank | 2/227 |

FOREIGN PATENTS OR APPLICATIONS

| | | | |
|---|---|---|---|
| 917,309 | 9/1946 | France | 2/227 |

*Primary Examiner*—H. Hampton Hunter
*Attorney, Agent, or Firm*—Rogers, Eilers & Howell

[57] ABSTRACT

Buttock-fitting trousers suitable for wear by both men and women. The trousers include leg portions and a separate seat portion shaped to fit the buttocks and attached to the leg portions by sewn seams passing rearwardly of said trousers to define the junction of the buttocks with the legs of the wearer.

9 Claims, 19 Drawing Figures

FORM-FITTING TROUSERS

SUMMARY OF THE INVENTION

This application is a continuation-in-part of U.S. patent application Ser. No. 350,724, filed April 13, 1973 now abandoned.

The present invention relates to trousers, or pants, in general, and particularly relates to buttock-fitting trousers adapted for wear by both men and women.

Buttock-fitting trousers have become fashionable in the field of both men's and women's clothing. Such trousers are often cut so as to fit not only the buttocks but the upper legs of the wearer in a skin-tight fashion, the lower portion of the trouser legs often being flared. Depending upon the tightness of fit, such trousers are often uncomfortable particularly at the tops of the legs in both front and back and crotch, and produce unsightly wrinkles particularly in the back where the legs and buttocks meet.

It is an object of the present invention to provide trousers which are comfortable, but which are fashioned to closely fit the buttocks of the wearer, and provide a neat, attractive, relatively wrinkle-free appearance.

Briefly, the present invention relates to buttock-fitting trousers suitable for wear by both men and women and comprising leg portions and a separate seat portion shaped to fit the buttocks and attached to the leg portions by sewn seams. Such seams are positioned to pass rearwardly of the wearer to define the junction of the buttocks with the legs of the wearer.

DETAILED DESCRIPTION OF PREFERRED EMBODIMENTS

Figure 16:
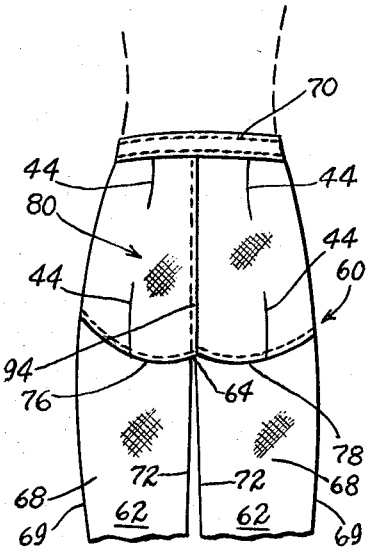
FIG. 16 shows a variation in the formation of the seat portion of the trousers of both embodiments shown.

Referring now to the drawing and particularly FIGS. 1 through 6, there is shown one embodiment of the trouser of this invention. The trouser (shown generally as 10) includes tubular leg portions 12 which are of uniform cross section from the crotch 14 to the bottom 16 thereof. It will be understood, of course, that the leg portions 12 need not be of uniform diameter throughout their length, but may, for example, be flared at the bottom or be made snug at the knees. While the trouser 10 is shown without an outside leg seam, such a seam could, of course, be provided. Joined to the upper edges of the leg portions by sewn seams 18 and 20 is a seat portion 22 which is shaped to fit the buttocks. It will be noted that the seams 18 and 20 extend from the waist at the side of the trouser downwardly, and in an arcuate pattern, rearwardly across the bottom of the buttock to the crotch, thus defining the junction between the seat portion 22 and back side of the leg portions. The result is a trouser of unique appearance and structure that provides a snug fit over the seat while allowing the leg portions to hang neatly and relatively wrinkle-free for greatly improved comfort and appearance. Such shaping of the seat may be accomplished, for example, by sewing together variously shaped pieces of fabric, or by using "darts" 23 and the like, in a manner known to the art. As depicted in the drawing, fabric portions 26, 28, 30, and 32 may be joined together along seams 38, 40, and 42, respectively, to form the seat portion 22. In lieu of the seams 38 and 42, darts 44 could be used to shape the seat portion as shown in FIG. 16.

Figure 1:
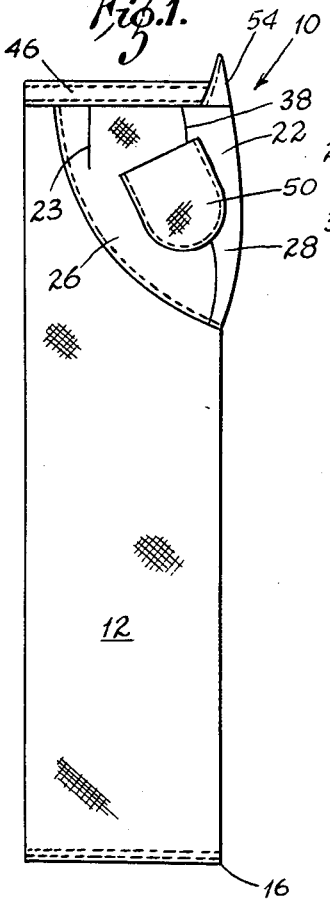
FIGS. 1 and 2 are views showing the left and right sides of one embodiment of the trousers of the present invention.
Figure 2:
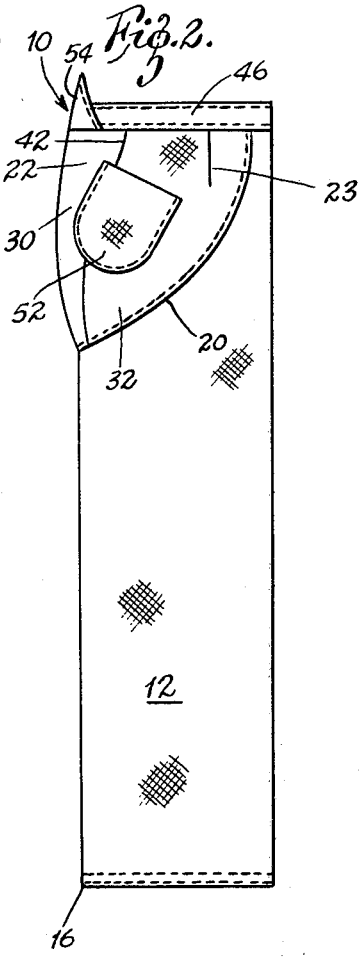
Figure 3:
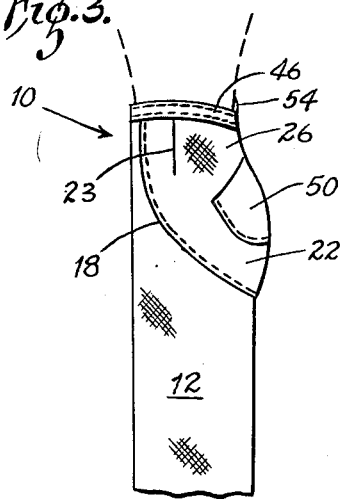
FIGS. 3, 4, 5, and 6 represent left, right, front, and rear views of the trousers of FIGS. 1 and 2 as worn by a wearer.
Figure 5:
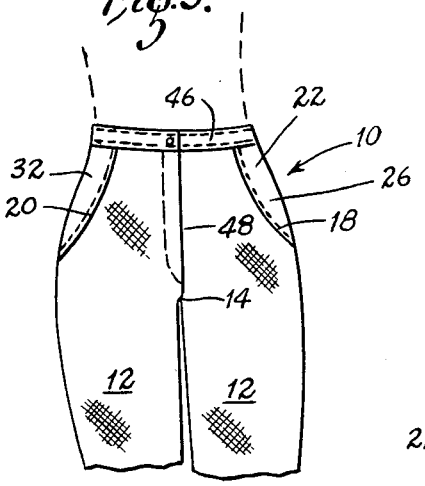
Figure 4:
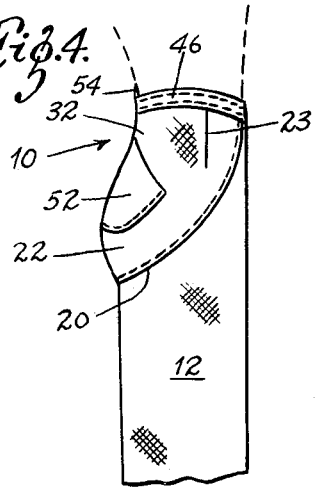

The upwardly and frontwardly extending portions of the seat portion are adapted to wrap about the hips of the wearer, as shown best in FIGS. 3, 4, and 5. The upper periphery of the seat portion 22 is sewn to a belt portion 46 which completely encirles the waist of the wearer. The above-mentioned upwardly and forwardly extending portions of seat portion 22 preferably do not meet in the front of the trousers, but are spaced apart as shown in FIG. 5, leg portions 12 extending upwardly in the front of the trousers between seams 18 and 20 for attachment to the belt portion 46. The front of the trousers may be provided with a fly opening centrally thereof, as shown at 48 in FIG. 5.

Figure 7:
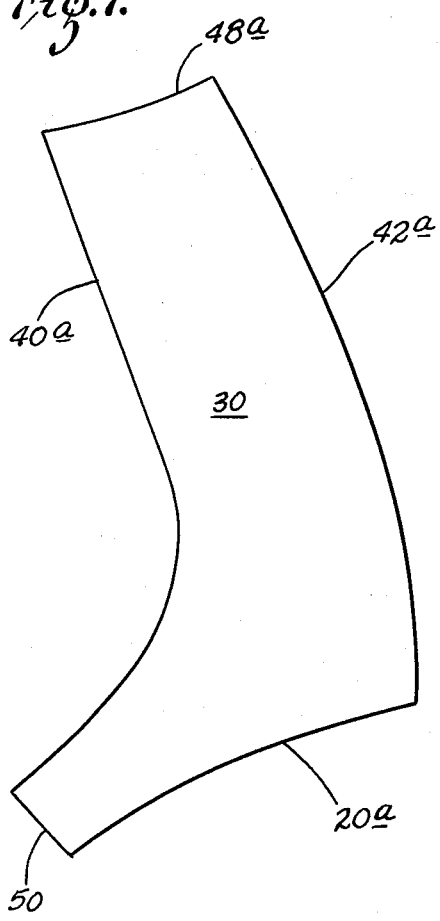
FIGS. 7, 8, and 9 are plan views of the panels in the area of the seat portion of the trouser of this invention.
Figure 8:
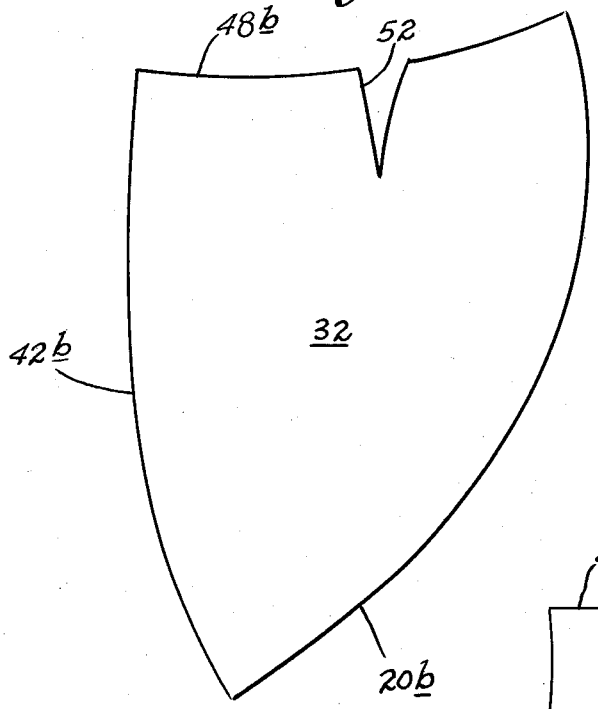
Figure 9:
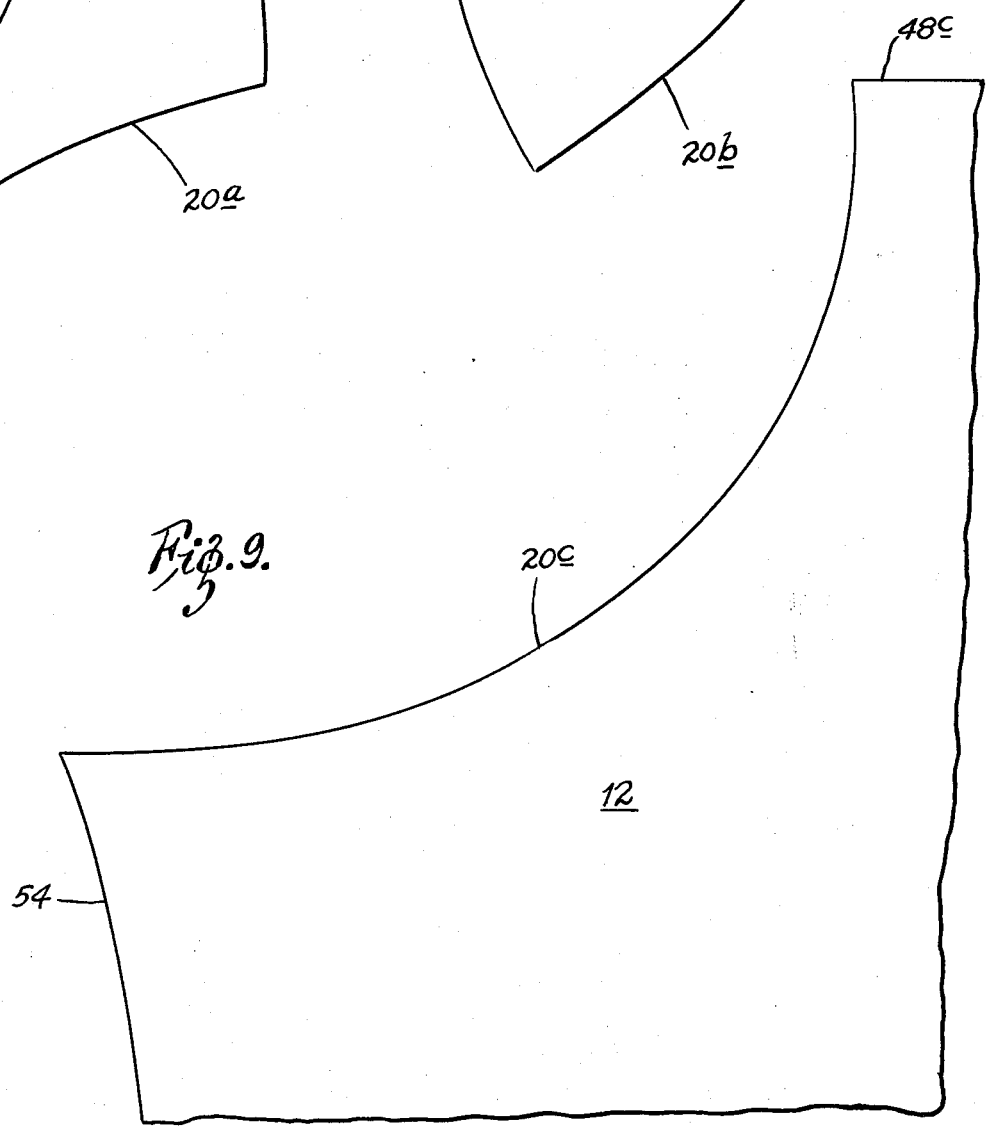
Figure 10:
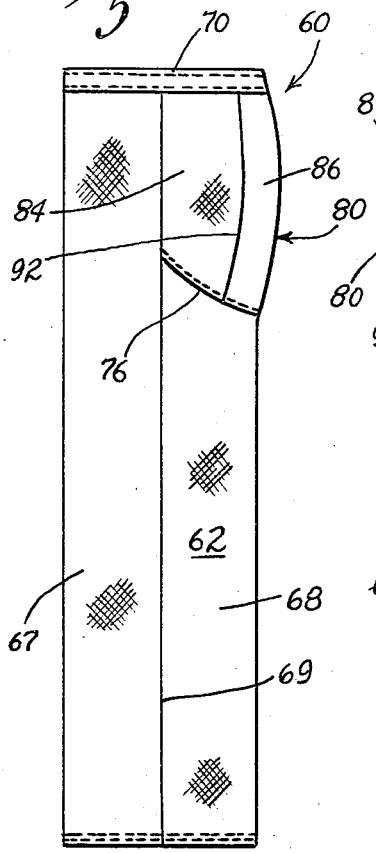
FIGS. 10 and 11 are views showing the left and right sides of another embodiment of the trousers of the present invention.
Figure 11:
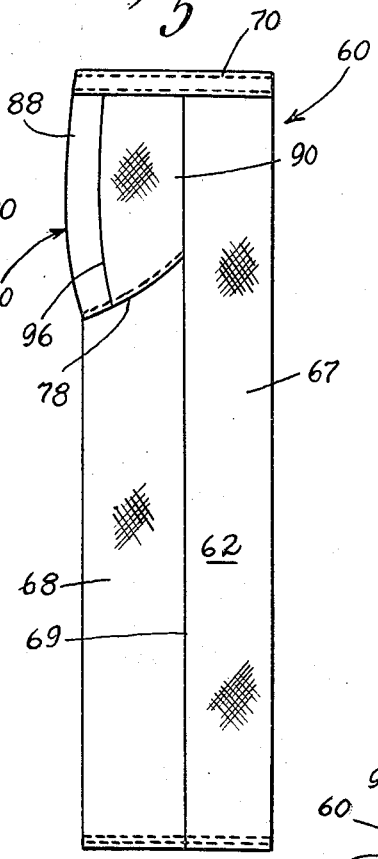
Figure 12:
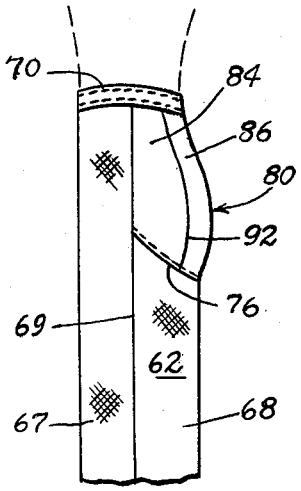
FIGS. 12, 13, 14, and 15 represent left, right, front and rear views of the trousers of FIGS. 10 and 11 as worn by a wearer.
Figure 13:
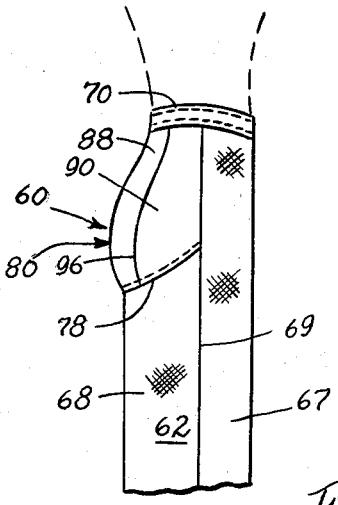
Figure 14:
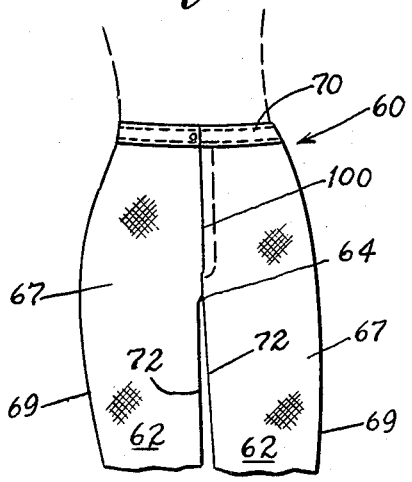

In FIGS. 7, 8, and 9 there are shown the patterns for the fabric portions or panels 30, 32, and 12 forming the right portion of the trouser 10. The patterns for the panels 26, 28, and 12 for the left portion of the trouser would simply be the mirror image of those shown. Thus, in FIG. 7 there is shown the pattern for the panel 30 having a top edge 48*a*, an outer edge 42*a*, a bottom edge 20*a*, and inner edges 50 and 40*a*. In FIG. 8 there is shown the pattern for the panel 32 having a top edge 48*b*, an outer edge 20*b*, and an inner edge 42*b*. V-shaped notch 52 is cut downwardly as shown from the top edge 48*b* to form the dart 23. In FIG. 9 there is shown a partial view of the pattern for the panel or leg portion 12 having upper edges 20*c* and 48*c*, and an inner edge 54. The outer edge is not shown as it simply forms the fly opening 48 at the top and is joined to the inner edges 50 and 54 below the fly opening to form an inside seam for the leg portion 12. Also, the bottom edge of the pattern for the leg portion 12 is not shown but could extend any length, such as for example the length shown in FIGS. 1 and 2.

Figure 6:
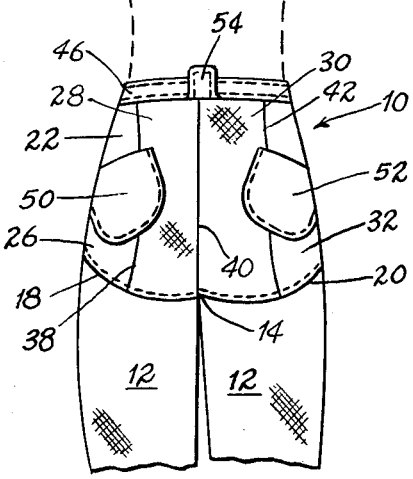

As is obvious, the edge 40*a* of the panel 30 is joined to a corresponding edge of the panel 28 to form the seam 40 shown in FIG. 6. The edge 42*a* of the panel 30 is joined to the edge 42*b* of the panel 32 to form the seam 42 shown in FIGS. 2 and 6. And the edges 20*a* of the panel 30 and 20*b* of the panel 32, which when the panels 30 and 32 are joined from a continuous edge, are joined to the edge 20*c* of the panel 12 to form the seam 20 as shown in FIGS. 2, 4, 5, and 6. The edge 50 of the panel 30 and the edge 54 of the panel 12 then form a continuous edge which is joined to the outer edge (not shown) of the panel 12 to form the inside seam of the leg portion. The notch 52 is brought together and sewn to form the dart 23, and the edges 48*a*, 48*b*, and 48*c* form a continuous upper edge to which the belt portion 46 is attached as clearly shown in each of FIGS. 1 through 6.

If darts are used as shown in FIG. 16, the panels 30 and 32 are made of a single piece of fabric shaped as shown in FIGS. 7 and 8 but with the patterns of those figures joined at the midportions of the edges 42*a* and 42*b*.

The attractive appearance of the trousers may be enhanced by providing back pockets 50 and 52 which are inwardly slanted as shown best in FIG. 6 so that the lower seams thereof are substantially parallel with seams 18 and 20. A tab 54 may be attached to the belt portion at the rear of the trousers in line with seam 40 as an attractive addition which may be employed to aid the wearer in putting the trousers on, hanging the trousers up, etc.

Referring to FIGS. 10 through 19 of the drawing, and particularly FIGS. 10 through 15, there is shown another embodiment of the trouser of this invention. It will be noted that the trouser of this embodiment is similar in many respects to that of the first-described embodiment with the primary difference being in the forward extent of the seam between the leg and seat portion of the pant. In this described embodiment that seam does not extend in a smooth curve forwardly and upwardly all the way to the waistband, but rather stops at an outside seam of the pant as will now be more fully described.

Thus, there is shown a trouser 60 which includes tubular leg portions 62 which are of uniform cross section from the crotch 64 to the bottom 66 thereof. It will be understood, that as with the first-described embodiment, the leg portions 62 need not be of uniform diameter throughout their length, but may, for example, be flared at the bottom or be made snug at the knees. Also, of course, the leg portions need not be full length.

The leg portions of the trouser 60 have front and rear portions or panels 67 and 68 joined to form outside seams 69 extending the full length of the trouser from its waistband 70 to its bottom 66, and inside seams 72 extending from the crotch 64 to the bottom 66.

Joined to the upper edges of the rear leg portions by sewn seams 76 and 78 is a seat portion 80 which is shaped to fit the buttocks of the wearer just as with the first-described embodiment. It will be noted that the seams 76 and 78 extend from the crotch, outwardly across the bottom of the buttock, and in an arcuate pattern slightly upwardly at the sides to intercept the side seam 69 where the seams 76 and 78 stop. Thus, just as with the seams 18 and 20 of the first-described embodiment, the seams 76 and 78 of this embodiment define the junction between the seat portion and the back sides of the leg portions. The difference is that in this described embodiment the seams 76 and 78 extend forwardly at the outsides of the trouser only to the outside seams 69, and do not continue forwardly and upwardly to the waistband as in the first-described embodiment. Therefore, the same functional result is achieved with the pant of this embodiment as with the pant of the first-described embodiment in providing a preshaped seat portion contoured to fit the buttocks of the wearer, and providing a trouser that is comfortable, but which closely fits the buttocks of the wearer and provides a neat, attractive, and relatively wrinkle-free appearance paticularly in the area of the seat and upper leg portions of the trouser and at the junction between these portions.

The shaping of the seat portion 80 may be accomplished, for example, by sewing together various shaped pieces of fabric, with or without darts or the like, in a manner known to the art. As depicted in FIGS. 10 through 15 of the drawing, fabric portions 84, 86, 88, and 90 (similar to the fabric portions 26, 28, 30, and 32 of the first-described embodiment) may be joined together along seams 92, 94, and 96, respectively (similar to seams 38, 40, and 42 of the first-described embodiment) to form the seat portion 80. In lieu of seams 92 and 96, darts 44 could be used to shape the seat portion as shown in FIG. 16.

As can be seen best from FIGS. 10 through 15, the leg portions of the pant to the front of the side seams 69 and 72 extend upwardly to the waistband 70 as is conventional with many pants known in the art. Also, the trouser of this embodiment may be provided with a fly opening, also conventional, as shown at 100 in FIG. 14. It is to be understood that while pockets have not been shown in this described embodiment of the invention, various types of pockets at various locations could be included. For example, hip pockets of the conventional patch type could be provided, and side pockets with openings at the side seams 69 just above the seams 76 and 78 could be provided.

Figure 17:
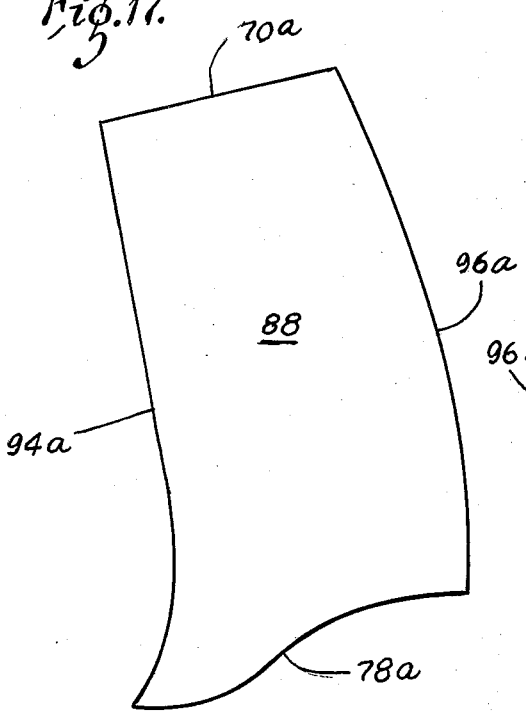
FIGS. 17, 18, and 19 are plan views of the panels in the area of the seat portion of the trouser of FIGS. 10 through 15.
Figure 18:
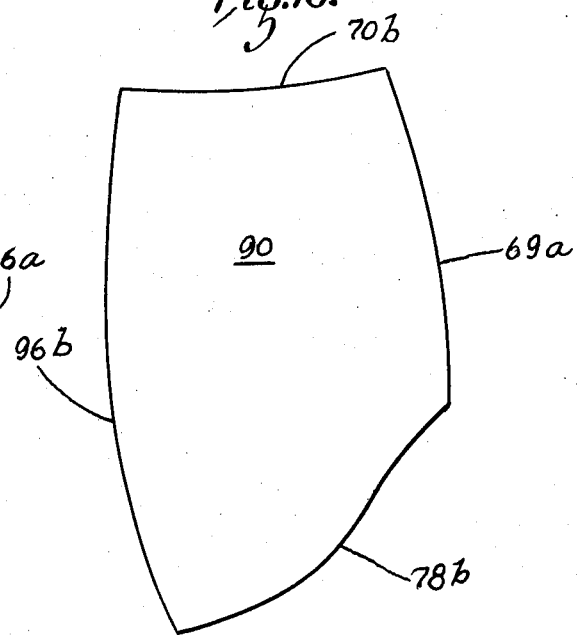
Figure 19:
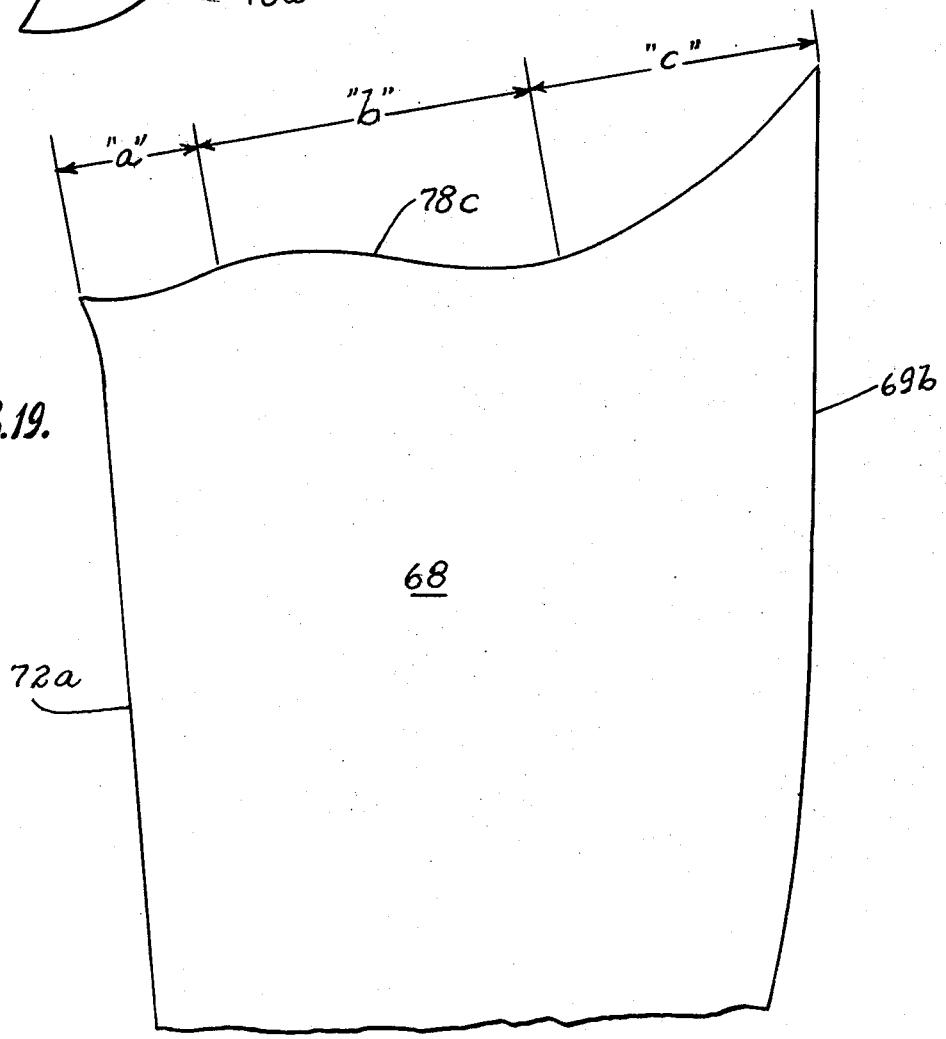

In FIGS. 17, 18, and 19 there are shown the patterns for the fabric portions or panels 88, 90, and 68 forming the right portion of the trouser 60. The patterns for the panels 84, 86, and 68 for the left portion of the trouser would simply be the mirror image of those shown. Thus, in FIG. 17 there is shown the pattern for the panel 88 having a top edge 70*a*, an outer edge 96*a*, a bottom edge 78*a*, and an inner edge 94*a*. In FIG. 18 there is shown the pattern for the panel 90 having a top edge 70*b*, an outer edge 69*a*, a bottom edge 78*b*, and an inner edge 96*b*. In FIG. 9 there is shown a partial view of the pattern for the rear panel 68 of the leg portion 62 having an upper edge 78*c*, an outer edge 69*b*, and an inner edge 72*a*. The bottom edge of the pattern for the leg portion 68 is not shown but could extend any length such as for example the length shown in FIGS. 10 and 11.

Figure 15:
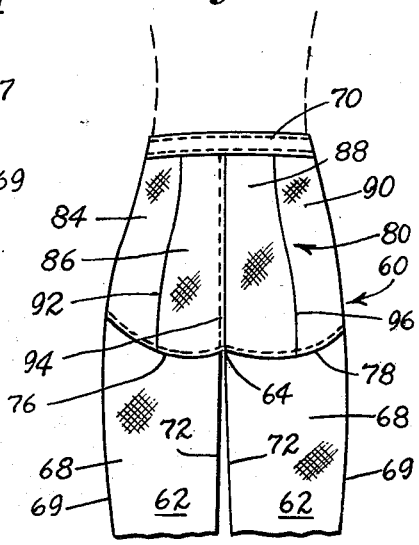

The edges 96a and 96b of the panels 88 and 90 are joined to form the seam 96 shown in FIG. 15. The edge 78*b* of the panel 90 is joined to the portion marked *c* of the edge 78*c* of the panel 68, and the edge 78a of the panel 88 is joined to the portion marked *b* of the edge 78*c* of the panel 68 to form the seam 78.

With the panel 88 joined to the panel 68, the portion marked *a* of the edge 78*c* of the panel 68 forms a continuation of the edge 94*a* of the panel 88. This continuous edge comprising the edge 94*a* and the portion *a* is joined to a corresponding continuous edge formed by the combination of the panels 86 and 68 of the left portion of the trouser to form the seam 94 extending from the waistband to the crotch.

With the panels so joined, the edges 69*a* and 69*b* form a continuous edge, which, when joined to an appropriate edge of the front leg panel 67, forms the outside seam 69. Similarly, the edge 72*a*, when joined to an appropriate edge of the front leg panel 67, forms the inside seam 72. The top edges 70*a* and 70*b* form a continuous edge for attachment to the waistband 70.

If darts are used as shown in FIG. 16, the panels 88 and 90 are made of a single piece of fabric shaped as shown in FIGS. 17 and 18 but with the patterns of those figures joined at the midportions of the edges 96*a* and 96*b*.

It will be understood that the foregoing description and accompanying drawing have been given by way of illustration and example, and changes in form of the elements, rearrangement of parts and substitution of equivalent elements which will be obvious to those skilled in the art are contemplated as within the scope of the invention which is limited only by the claims which follow.

What is claimed is:

1. A buttock-fitting trouser comprising leg portions and a separate seat portion, said seat portion having a right buttock half and a left buttock half, means for attaching said seat portion to the leg portion including seams defining the junction of the buttocks with the legs of the wearer, said seams extending in a smooth curve generally from the crotch, laterally outwardly across the rear of the wearer, around the sides and to the front thereof, and then upwardly to the waist of the trouser, each buttock half being outwardly convexly shaped, at least in part, by means of a seam extending at least part way between the seam defining the junction of the buttocks with the legs of the wearer and the waist of the trouser.

2. The trouser of claim 1 wherein each buttock half has at least two panels joined by a seam extending from the seam defining the junction of the buttocks with the legs of the wearer to the waist of the trouser.

3. The trouser of claim 1 wherein the leg portions extend upwardly between said seams at the front of the trouser to the waist.

4. The trouser of claim 1 wherein the seam of each buttock half extending at least part way between the seam defining the junction of the buttocks with the legs of the wearer and the waist of the trouser, extends upwardly from the seam defining said junction.

5. The trouser of claim 1 wherein the seam of each buttock half extending at least part way between the seam defining the junction of the buttocks with the legs of the wearer and the waist of the trouser, extends downwardly from the waist of the trouser.

6. The trouser of claim 1 wherein the buttock halves are joined to form a seam extending from generally the crotch to the waist of the trouser.

7. A buttock-fitting trouser comprising leg portions and a separate seat portion, means for attaching said seat portion to the leg portions including seams defining the junction of the buttocks with the legs of the wearer, said seat portion further comprising a right buttock half and a left buttock half, each buttock half of said trouser having an inner panel and an outer panel each preshaped to provide for said buttock-fitting, the inner panels of the buttock halves being joined to form a seam at their junction extending from generally the crotch to the waist of the trouser, and the inner and outer panels of each of the buttock halves being joined by a seam extending from the seam defining the junction of the buttocks with the legs of the wearer to the waist of the trouser, said last named seam being curvalinear and outwardly convexly shaped at least at a lower portion thereof whereby when said inner and outer panels forming each buttock half are seamed together said assembled inner and outer panels present an outwardly convex configuration, said last named seam cooperating with said seams defining the junction of the buttocks with the legs of the wearer to define a preshaped outwardly convex seat portion smoothly contoured to fit the buttocks of the wearer.

8. The trouser of claim 7 wherein the leg portions have side seams, and wherein said seams defining said junctions of the legs and buttocks extend generally from the crotch outwardly along the junction of the legs and buttocks and then forwardly to terminate at said side seams.

9. The trouser of claim 7 wherein said seams defining said junction of legs and buttocks runs in a smooth curve from the waist at the front of the trouser, downwardly and then laterally around the side and across the rear of the wearer and terminate generally at the crotch.

* * * * *